US006624395B2

(12) United States Patent
Kishimoto

(10) Patent No.: US 6,624,395 B2
(45) Date of Patent: Sep. 23, 2003

(54) SWITCH CONTROL DEVICE AND METHOD, AND HEATING COOKER HAVING THE CONTROL DEVICE

(75) Inventor: Hidemi Kishimoto, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 165 days.

(21) Appl. No.: 09/866,748

(22) Filed: May 30, 2001

(65) Prior Publication Data

US 2002/0011483 A1 Jan. 31, 2002

(30) Foreign Application Priority Data

May 31, 2000 (JP) ..... 2000-163753

(51) Int. Cl.[7] ..... H05B 1/02; H05B 6/66
(52) U.S. Cl. ..... 219/491; 319/702
(58) Field of Search ..... 219/490, 491, 219/492, 702, 715, 719, 720; 99/325

(56) References Cited

U.S. PATENT DOCUMENTS 5,345,067 A * 9/1994 Ohta et al. ..... 219/720
5,349,164 A * 9/1994 Ohta ..... 219/506
5,373,142 A * 12/1994 Ohshima et al. ..... 219/506
5,607,611 A * 3/1997 Lee ..... 219/702
6,525,301 B1 * 2/2003 Graves et al. ..... 219/702

* cited by examiner

*Primary Examiner*—Sang Paik
(74) *Attorney, Agent, or Firm*—Rabin & Berdo, P.C.

(57) ABSTRACT

The present invention provides a device for signal control of a switch which outputs a first signal in response to a turning operation thereof and outputs a second signal in response to a depressing operation thereof. If one of the first and second signals is outputted in response to a corresponding one of the switch turning operation and the switch depressing operation and the other signal is thereafter outputted in response to the other operation within a predetermined period, the control device nullifies the other signal. With this arrangement, a heating cooker provided with the switch is prevented from performing an under-heat or over-heat cooking operation on the basis of a misoperation of the switch. Further, the need for resetting a cooking period is obviated which may otherwise arise from the misoperation of the switch.

10 Claims, 5 Drawing Sheets

SWITCH CONTROL DEVICE AND METHOD, AND HEATING COOKER HAVING THE CONTROL DEVICE

This application is based on Application No. 2000-163753 filed in Japan, the contents of which are incorporated herein by reference.

BACKGROUND OF THE INVENTION

1. Field of the Invention

The present invention relates to a heating cooker and, more particularly, to a microwave oven. The invention further relates to a switch control device and method to be employed in such a heating cooker.

2. Description of Related Art

Hitherto known as a switch for use in a microwave oven is a combination switch which functions as a push switch for outputting a cooking start signal in response to depression of the switch and as a rotary switch for outputting a cooking period signal according to the amount of turning of the switch.

The known switch for the microwave oven has two functions and, therefore, is contributable to an easy-to-handle design of the microwave oven with a reduced number of switches. However, the switch has drawbacks with a tendency toward the following misoperations due to its two functions as the push switch and as the rotary switch.

When a user depresses the switch to start a cooking operation after having set a cooking period by turning the switch, a misoperation of the switch is liable to occur with the switch inadvertently turned. Particularly, the user is liable to depress the switch while inadvertently turning the switch, whereby the cooking period once set is changed at the start of the cooking operation.

Further, the user may inadvertently depress the switch when turning the switch for the setting of the cooking period.

With either of the misoperations of the switch, over-heating or under-heating occurs because the cooking period is not set as intended by the user at the start of the cooking operation.

If the user becomes aware of the misoperations of the switch, the user may interrupt the cooking operation to reset the cooking period, but such a resetting operation is troublesome. Therefore, a switch is desired which requires no resetting operation.

SUMMARY OF THE INVENTION

In view of the foregoing, it is an object of the present invention to improve the operability of a depressible rotary switch for use in a heating cooker.

It is another object of the present invention to provide a switch control device and method which ensure an improved operability of a depressible rotary switch by rejecting an output signal generated due to a misoperation of the switch.

It is further another object of the present invention to improve the operability of a heating cooker having a depressible rotary switch.

In accordance with the present invention, there is provided a device for signal control of a switch which outputs a first signal in response to a turning operation thereof and outputs a second signal in response to a depressing operation thereof. If one of the first and second signals is outputted in response to a corresponding one of the switch turning operation and the switch depressing operation and the other signal is thereafter outputted in response to the other operation within a predetermined period, the control device nullifies the other signal.

With this arrangement, a heating cooker provided with the switch is prevented from performing an under-heat or over-heat cooking operation on the basis of a misoperation of the switch. Further, the need for resetting a cooking period is obviated, which may otherwise arise from the misoperation of the switch.

The foregoing and other objects, features and effects of the present invention will become more apparent from the following detailed description with reference to the attached drawings.

DESCRIPTION OF PREFERRED EMBODIMENTS

Figure 1:
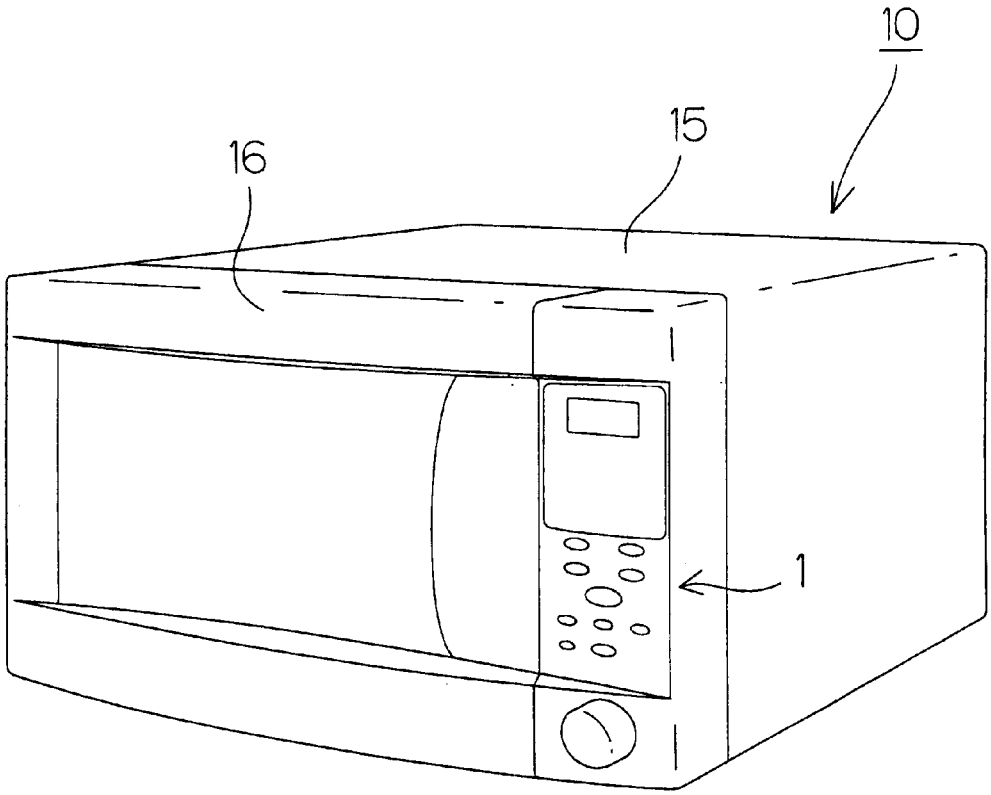
FIG. 1 is a perspective view illustrating the appearance of a microwave oven according to one embodiment of the present invention.

FIG. 1 is a perspective view illustrating the appearance of a microwave oven according to one embodiment of the present invention. The microwave oven 10 includes a main body housing 15, and a door 16 covering a front opening of the main body housing 15 in an openable manner. With the door 16 being open, an object to be cooked is put into and taken out of a heating chamber (not shown) in the main body housing 15. An operation panel 1 is provided on a right side of a front face of the main body housing 15.

Figure 2:
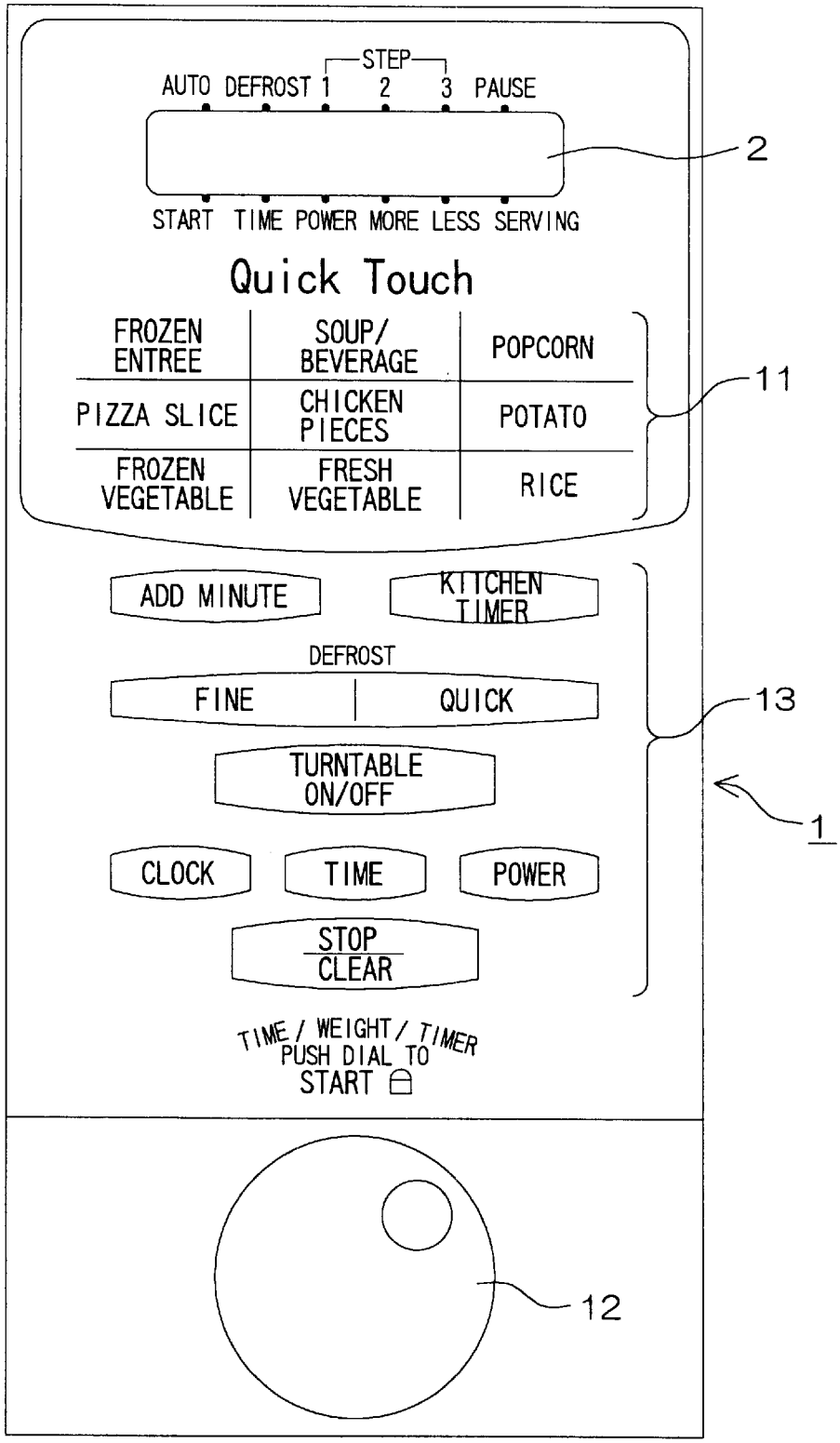
FIG. 2 is a front view of an operation panel provided on a right side of a front face of the microwave oven shown in FIG. 1.

FIG. 2 is a front view of the operation panel 1. A display 2, a plurality of cooking mode selection switches 11, a plurality of function switches 13 and an RP switch 12 are arranged on the operation panel 1 in this order from the top to the bottom thereof. The display 2 is comprised, for example, of a liquid crystal display panel (LCD), and is adapted to switchably display a present time and the remainder of a cooking period. Other information, e.g., a selected cooking mode and an error indication may be displayed on the display 2.

The RP switch 12 has two functions as a rotary switch and as a push switch. The RP switch 12 outputs a cooking period signal in response to a turning operation thereof, and outputs a cooking start signal in response to a depressing operation thereof.

Figure 3:
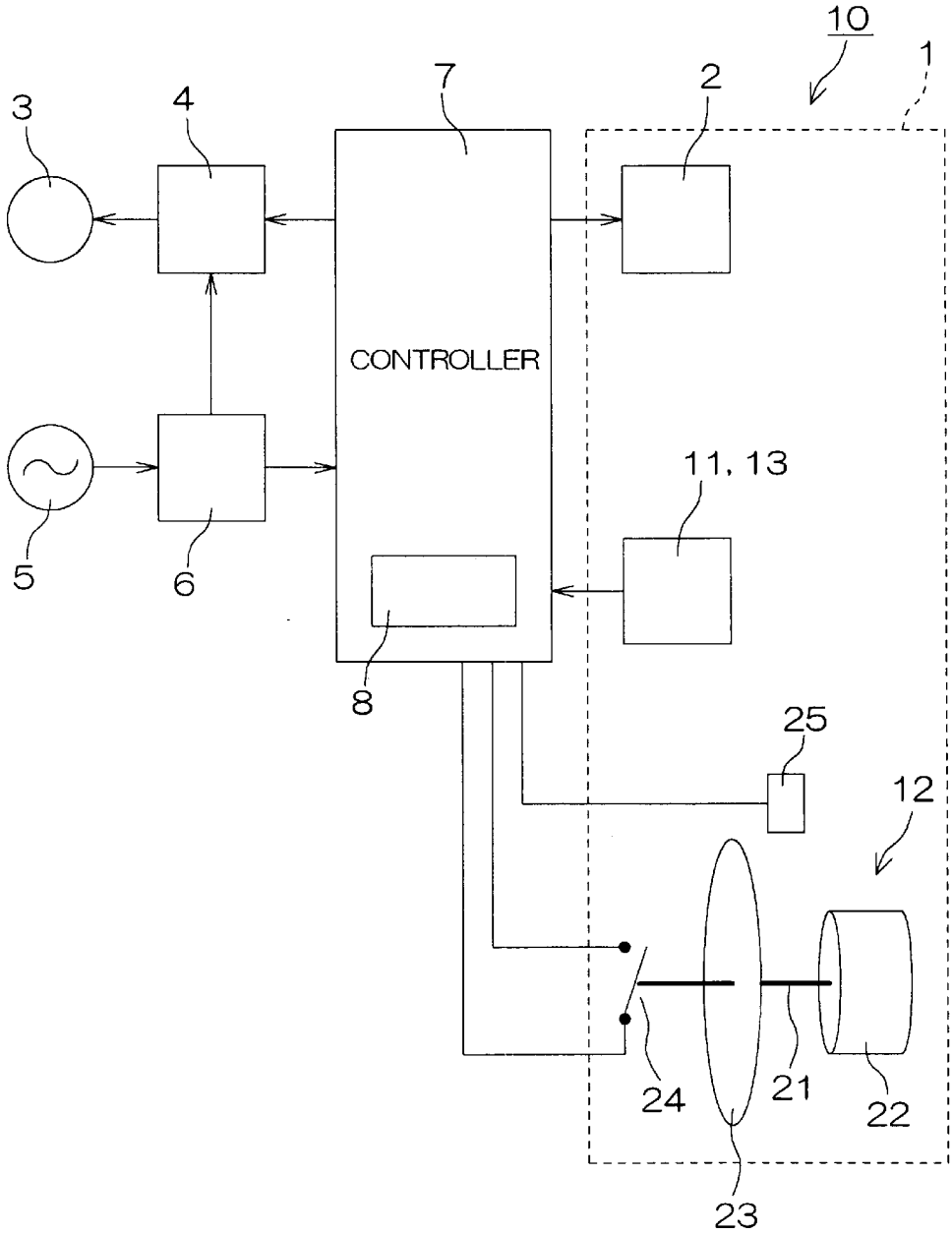
FIG. 3 is a block diagram illustrating the electrical construction of the microwave oven according to the embodiment.

FIG. 3 is a block diagram illustrating the electrical construction of the microwave oven 10. The operation of the microwave oven 10 is controlled by a controller 7. The controller 7 comprises a microprocessor and the like, and incorporates a timer 8. The timer 8 times a lapse of a predetermined period which will be described later. The timer 8 may be implemented as a hardware circuit or on a software basis.

Signals from the cooking mode selection switches 11, the function switches 13 and the RP switch 12 provided on the operation panel 1 are applied to the controller 7. The controller 7 performs predetermined operations on the basis of the signals from these switches. That is, the controller 7 controls a driver circuit 4 to drive a heating device 3. The heating device 3 comprises, for example, a heater, a magnetron and the like. The object placed in the heating chamber within the main body housing 15 is heated by the heating device 3.

The microwave oven 10 includes a power supply circuit 6 for supplying power to the microwave oven 10. A voltage from a utility AC power source 5 (e.g., AC100V) is applied to the power supply circuit 6. The power supply circuit 6 shapes the waveform of the utility AC voltage to supply a source voltage to the driver circuit 4 and the controller 7.

The controller 7 further controls the display 2 to display various information on the display 2.

The RP switch 12 which functions as the rotary switch and as the push switch includes a rotation shaft 21, a knob 22 fixed to a front end of the rotation shaft 21, a disk 23 fitted around a midportion of the rotation shaft 21, a depression switch 24 disposed at a rear end of the rotation shaft 21, and a rotation detector 25 disposed in association with the disk 23. The rotation shaft 21 and the disk 23 are rotated when the knob 22 is turned. The rotation detector 25 detects the rotation of the disk 23, and the direction and amount of the rotation. The amount of the rotation detected by the rotation detector 25 is applied to the controller 7, and converted into a period. Thus, the switch 12 functions as the rotary switch. When the knob 22 is depressed rearward, the depression switch 24 is switched by the rear end of the rotation shaft 21. Thus, the switch 12 functions as the push switch.

The construction of the RP switch 12 per se is known.

Figure 4:
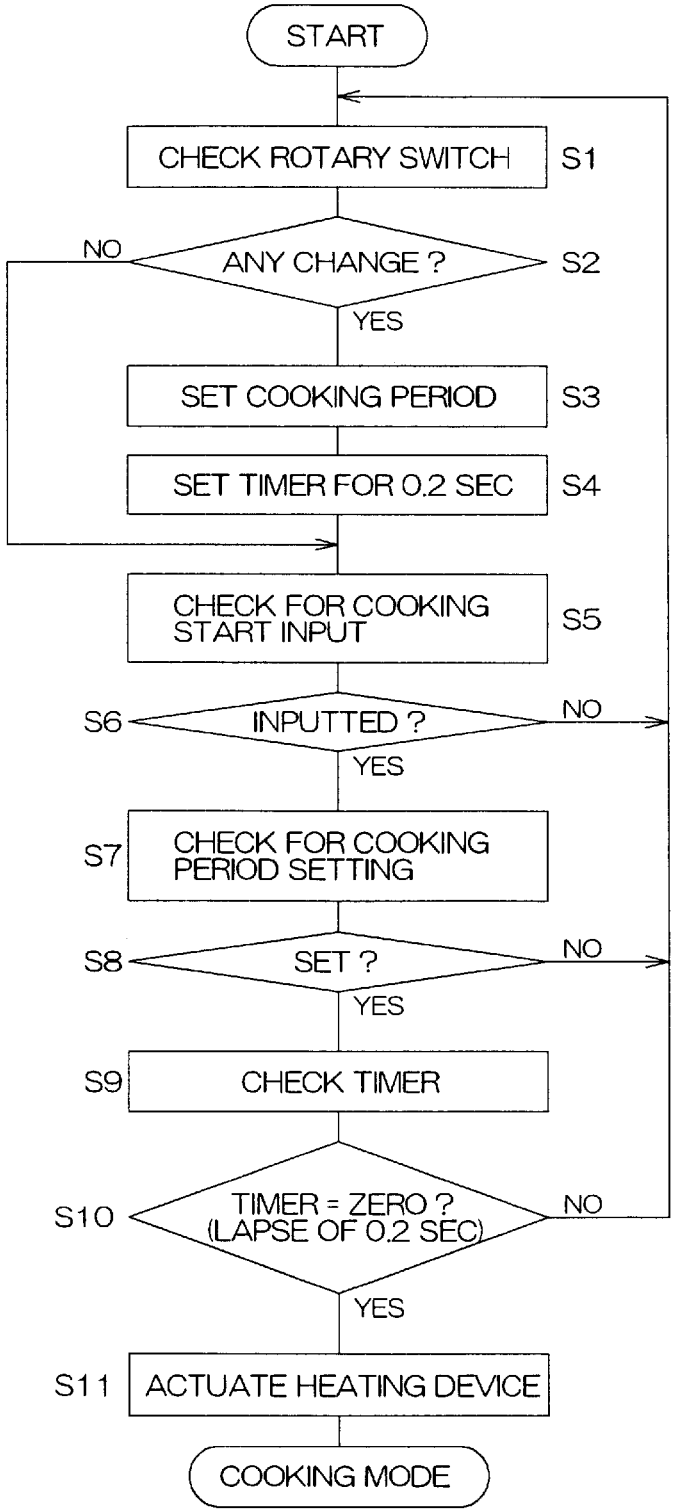
FIG. 4 is a flow chart for explaining a control operation to be performed by a controller shown in FIG. 3.

Next, an explanation will be given to a control operation to be performed by the controller 7 shown in FIG. 3 with reference to a flow chart of FIG. 4.

When the power is turned on, it is judged in Steps S1 and S2 whether or not the RP switch 12 is turned. If the RP switch 12 is turned, a signal outputted in accordance with the turning operation is detected to set a cooking period in Step S3. More specifically, when the RP switch 12 is turned, a pulse signal of a 0.02-second cycle, for example, is applied to the controller 7 from the rotation detector 25. The pulse signal corresponds to the amount of the rotation of the knob 22, and the controller 7 converts the amount of the rotation into a period which is employed as the cooking period to be set. At the same time, the timer 8 is set for 0.2 second and started in Step S4. That is, a lapse of 0.2 second is timed after the setting of the cooking period.

If it is judged in Step S2 that the switch is not turned, the process goes to Step S5 from Step S2.

In Steps S5 and S6, it is judged whether or not the RP switch 12 is depressed. If the RP switch 12 is not depressed, the process returns to Step S1. If the RP switch 12 is depressed, it is judged in Steps S7 and S8 whether or not the cooking period is set. If the cooking period is not set, the process returns to Step S1. That is, the cooking operation is not started even if the RP switch 12 is operated with the cooking period being not set.

If it is judged in Step S8 that the cooking period is set, it is judged in Steps S9 and S10 whether or not the timer 8 expires. If the timer 8 does not expire, i.e., if 0.2 second has not elapsed after the setting of the cooking period, it is judged that the depressing operation of the RP switch 12 is erroneous, so that the cooking start signal outputted in response to the depressing operation of the RP switch 12 is rejected and the process returns to Step S1.

On the other hand, if it is judged in Step S10 that the timer 8 expires, the depressing operation of the RP switch 12 is not considered erroneous but effective, so that the cooking start signal outputted in response to the depressing operation of the RP switch 12 is accepted and the heating device 3 is actuated (Step S11).

As described above, the timer 8 starts timing a lapse of the predetermined period (0.2 second) upon completion of the turning operation of the RP switch 12 for the input of the cooking period and, if the RP switch 12 is depressed within 0.2 second after the setting of the cooking period, it is judged that the depressing operation is erroneous, so that the cooking operation is not started. Even if the RP switch 12 is erroneously depressed when the RP switch 12 is turned, the cooking operation is not started in response to the depressing operation. Therefore, the operability of the RP switch 12 is improved. In addition, the cooking operation is prevented from being started by the misoperation.

As a result, the cooking period is set as intended by the user, so that a cooking failure can be eliminated which may otherwise occur due to the misoperation.

Figure 5:
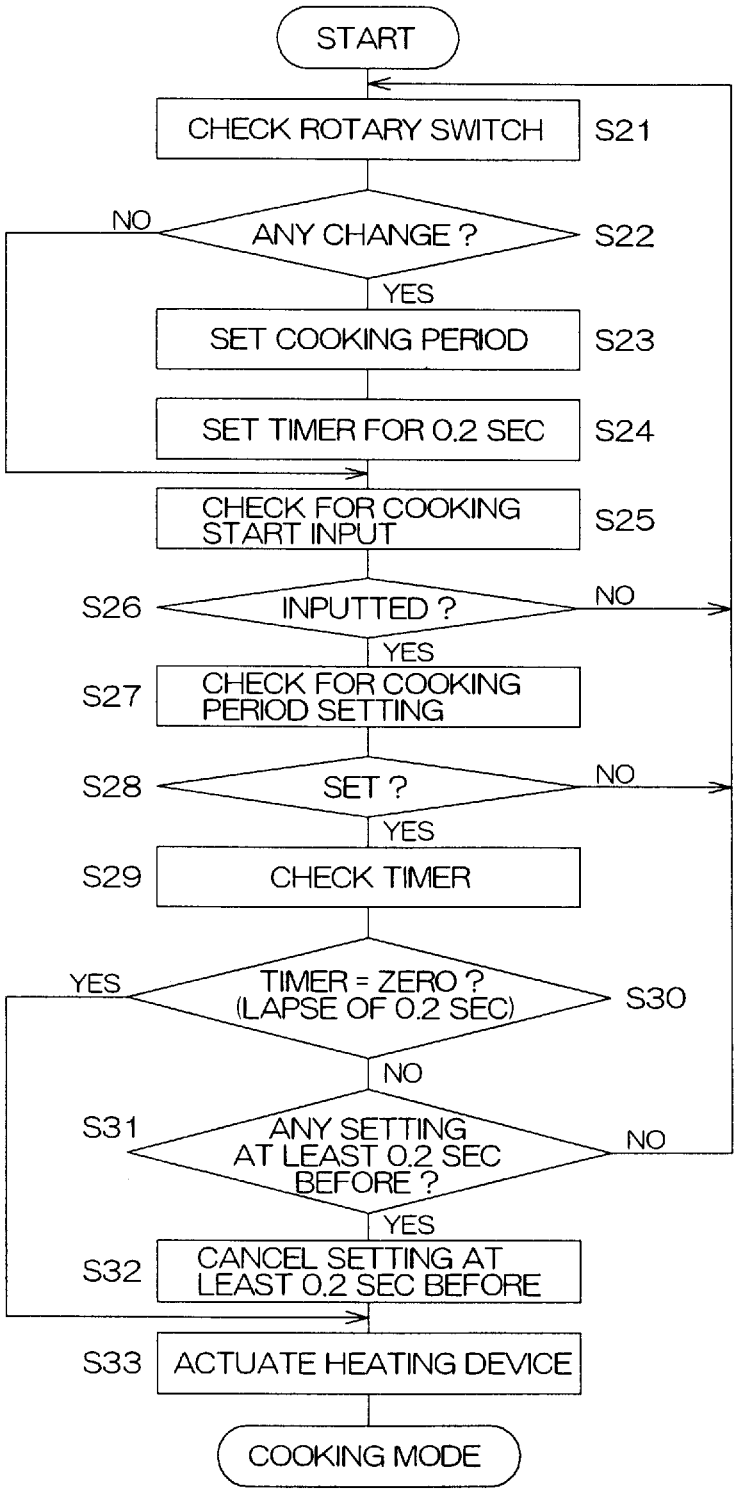
FIG. 5 is a flow chart for explaining another control operation to be performed by the controller shown in FIG. 3.

FIG. 5 is a flow chart for explaining another control operation to be performed by the controller 7.

Steps S21 to S28 in FIG. 5 are the same as Steps S1 to S8 in FIG. 4 and, therefore, no explanation will be given thereto to avoid duplication.

The process shown in the flow chart of FIG. 5 is characterized in that, if the timer 8 does not expire when the timer 8 is checked in Steps S29 and S30, it is judged in Step S31 whether or not the cooking period is set at least 0.2 second before the timer check. If the cooking period is not set at least 0.2 second before the timer check, the process returns to Step S21. On the other hand, if the cooking period is set at least 0.2 second before the timer check, the setting of the cooking period based on a signal inputted within 0.2 second after the timer check is canceled in Step S32, and the process goes to Step S33.

If it is judged in Step S30 that the timer 8 expires, the process goes to Step S33, so that the heating device 3 is actuated to start the cooking operation.

In accordance with the control operation shown in FIG. 5, the cooking period once set by turning the RP switch 12 is not changed even if the user thereafter inadvertently turns the RP switch 12 when pressing the RP switch 12. Therefore, the cooking operation is started with the cooking period set as intended by the user. As a result, a cooking failure can be eliminated which may otherwise occur due to the misoperation. In addition, the need for resetting the cooking period can be obviated, thereby improving the operability of the microwave oven.

It should be understood that the present invention be not limited to the embodiment described above, but various modifications may be made within the scope of the present invention defined by the appended claims. For example, the present invention is applicable not only to the microwave oven but also to an oven, a toaster and the like.

What is claimed is:

1. A heating cooker comprising:

heating means for heating an object to be cooked;

a switch functioning as a rotary switch and as a push switch for outputting a cooking period signal in response to a turning operation thereof and outputting a cooking start signal in response to a depressing operation thereof; and control means for controlling the heating means on the basis of the signals applied from the switch;

wherein the control means includes signal nullifying means for prohibiting a process based on the cooking start signal if the cooking start signal is inputted from the switch within a predetermined period after the cooking period signal is inputted from the switch.

2. A heating cooker as set forth in claim 1, wherein the control means has a timer function for timing a lapse of the predetermined period after the cooking period signal is inputted from the switch.

3. A heating cooker comprising:

heating means for heating an object to be cooked;

a switch functioning as a rotary switch and as a push switch for outputting a cooking period signal in response to a turning operation thereof and outputting a cooking start signal in response to a depressing operation thereof; and control means for controlling the heating means on the basis of the signals applied from the switch;

wherein the control means includes signal selective means for, if the cooking period signal is inputted from the switch and the cooking period signal and the cooking start signal are thereafter inputted from the switch within a predetermined period, nullifying the cooking period signal inputted within the predetermined period and accepting only the cooking start signal.

4. A switch control device comprising:

a switch functioning as a rotary switch and as a push switch for outputting a first signal in response to a turning operation thereof and outputting a second signal in response to a depressing operation thereof; and a controller which receives the first and second signals inputted from the switch;

wherein, if one of the first and second signals is inputted and the other signal is thereafter inputted within a predetermined period, the controller is prohibited from performing a process based on the other signal.

5. A switch control device as set forth in claim 4, which is a device for setting a cooking period and starting a cooking operation for a heating cooker.

6. A switch control device as set forth in claim 5, wherein the first signal is a cooking period signal, and the second signal is a cooking start signal.

7. A switch control device comprising:

a switch functioning as a rotary switch and as a push switch for outputting a first signal in response to a turning operation thereof and outputting a second signal in response to a depressing operation thereof; and a controller which receives the first and second signals inputted from the switch;

wherein, if one of the first and second signals is inputted and both of the first and second signals are thereafter inputted within a predetermined period, the controller is prohibited from performing a process based on the one signal and permitted to perform a process based on the other signal.

8. A switch control device as set forth in claim 7, which is a device for setting a cooking period and starting a cooking operation for a heating cooker.

9. A switch control device as set forth in claim 8, wherein the first signal is a cooking period signal, and the second signal is a cooking start signal.

10. A method for controlling a switch for use in a heating cooker, the switch functioning as a rotary switch and as a push switch, the method comprising:

causing the switch to output a first signal in response to a turning operation thereof;

causing the switch to output a second signal in response to a depressing operation thereof; and if one of the turning operation and the depressing operation is performed and the other operation is thereafter performed within a predetermined period, prohibiting a process based on one of the first and second signals correspondingly outputted in response to the other operation.

* * * * *